US006181362B1

(12) United States Patent
Laberge

(10) Patent No.: US 6,181,362 B1
(45) Date of Patent: Jan. 30, 2001

(54) FAULT TOLERANT LASER DIODE ARRAY

(75) Inventor: Michel Laberge, Bowen Island (CA)

(73) Assignee: Creo Srl, Burnaby (CA)

( * ) Notice: Under 35 U.S.C. 154(b), the term of this patent shall be extended for 0 days.

(21) Appl. No.: 09/272,746

(22) Filed: Mar. 11, 1999

(51) Int. Cl.[7] ..... B41J 2/455
(52) U.S. Cl. ..... 347/233; 347/238; 347/41
(58) Field of Search ..... 347/40, 41, 238, 347/233; 399/177, 198, 382

(56) References Cited

U.S. PATENT DOCUMENTS

| | | | | |
|---|---|---|---|---|
| 4,900,130 | | 2/1990 | Haas | 372/50 |
| 5,369,659 | | 11/1994 | Furumoto et al. | 359/198 |
| 5,640,183 | * | 6/1997 | Hackleman | 347/40 |

* cited by examiner

*Primary Examiner*—N. Le
*Assistant Examiner*—Hai C. Pham
(74) *Attorney, Agent, or Firm*—Oyen Wiggs Green & Mutala

(57) ABSTRACT

A method and apparatus for a fault tolerant recording system using a laser diode array is disclosed. The laser diode array comprises individually addressable diodes which are used to record data on parallel tracks of a recording surface. Narrowing the separation between the parallel recording tracks without modifying the diode spacing within the array may be accomplished by precise movement of the diode array with respect to the recording surface, so as to generate an interleaved recording pattern. Fault tolerance is added by creating a redundancy (integrated into the interleaving mechanism) wherein each track on the recording surface is assigned a primary diode and a secondary diode, only one of which is active at a particular time. If a failure occurs in the primary diode assigned to a particular track, then the secondary diode is activated, and the recording of data on the particular track remains unaffected.

23 Claims, 7 Drawing Sheets

FAULT TOLERANT LASER DIODE ARRAY

FIELD OF THE INVENTION

The invention herein disclosed relates to array recording systems and more specifically to printing systems employing arrays of recording elements.

BACKGROUND OF THE INVENTION

The invention disclosed in this application relates to recording using an array of recording devices called "array elements". The most common recording array element in use today is the laser diode. For the purposes of this application, the terms "array element" and "diode" are used interchangeably; however, use of the word "diode" should not limit the invention as it is intended to apply to all arrays of recording devices regardless of the nature of the array element itself.

Laser diodes have been used in many prior art recording techniques as have monolithic laser diode arrays. Monolithic laser diode arrays used in recording typically contain 10–100 diodes and the recording is done with either photonic exposure or thermal exposure. Photonic systems react to the total exposure to photon energy, such that each photon striking the recording surface helps to expose it. Conversely thermal systems respond to peak temperatures and must reach a certain threshold for exposure to occur. Thermal systems usually operate in the IR, while photonic systems usually operate in the visible or UV range, but either system can operate in any range of the spectrum. Each diode may be a single mode source or a short multi mode stripe and is said to record a particular "track" or "raster line" on the recording surface. Note that throughout this application the terms "track" and "raster line" are used interchangeably. Diode arrays can contain anywhere from 10 to 1000 diodes. In typical printing applications, the tracks on the recording surface are spaced between 10 and 20 microns apart, but for data storage applications, the tracks can be as close together as 0.5 microns in order to permit high density recording.

A current problem associated with the use of diode arrays is the diode spacing within the array. Current technology in semiconductor fabrication can only produce arrays in which the diodes are spaced in the neighborhood of 10–100 microns and, as mentioned above, recording requires data spacing down to 0.5 microns. The laser diodes can not be de-magnified optically because of the large numerical aperture of the laser emission. Consequently, to achieve the required density of raster lines on the recording surface, a non-optical method is required to reduce the effective raster line spacing. Such methods normally include one of two techniques: angled diode arrays and interleaving.

An angled diode array is depicted in FIG. 1-A. The diode array 10 is maintained at an angle θ with respect to the recording surface 6. Diode spacing d is typically between 10 and 100 $\mu$m on the array, but because the array is angled, the spots (r=1–5) which are printed in the tracks on the recording surface 6 are more closely spaced with separations of Y=dcos θ. Printing the data onto the recording surface 6 in a linear fashion requires that the diodes of the angled array 10 be activated at delayed intervals. This delay architecture is depicted in FIG. 1-B. The desired location of the printing dots (r=1–5) is in a line on the printing surface 6. Because the printing surface 6 is scanning (i.e. moving relative to the laser diode array 10) in direction 7, the various lasers must be delayed so that they are not activated until the desired location (r=1–5) on the printing surface 6 is reached. Diode n=5 is not delayed, and data is fed straight into it. However, data flowing to diode n=4 must be delayed slightly until spot r=4 is directly under diode n=4. The required delay D is easily determined from the diode spacing d, the array angle θ and the scan velocity (not shown). The delay required for the other diodes n=1, 2 and 3 is simply a multiple of that required for n=4. Using this technique of coupling the angled diode array with digital delays, the effective raster line spacing Y can be reduced on the recording surface overcoming the diode spacing limitation of semiconductor fabrication technology.

A second method of overcoming the diode spacing limitation involves interleaving. Interleaving comprises discrete, precise movements of a diode array, such that at each discrete diode array location the recording occurs only on a limited number of raster lines. As the diode array is moved to subsequent discrete locations, recording occurs between the previously recorded raster lines. The interleaving process is extended until all of the tracks have been recorded upon. An interleaving process is thoroughly explained in U.S. Pat. No. 4,900,130 (hereinafter '130), which is hereby incorporated by reference. The following is a brief explanation of the interleaving process as described in the '130 patent.

In the discussion herein of the prior art and of the present invention, certain elements of the invention are referred to by letters. The letters and the elements they refer to are as follows:

d-center-to-center spacing of the array elements (i.e. diodes) or of their images on the recording medium;

N-number of array elements;

n-index number of an element in an array;

p-number of a position of the array;

S-step size of the array;

r-index number of a parallel track;

Y-spacing between parallel tracks on the recording medium ("effective track spacing");

k-an integer called the "interleaving factor", that is, the number which determines the number of tracks interleaved into a given set of parallel tracks that is recorded at a particular array position; and D-delay for an element n expressed in the number of positions of the array.

An array of N elements can expose tracks on a recording surface of effective track spacing Y, which is a fraction of the spacing d of the array elements, by translating the array a constant, discrete step size S. Typically, an array step size:

$$S=Nd/k \tag{1}$$

is selected, provided that the lowest common multiple of N and k is Nk. If N and k have common factors, then the interleaving will produce multiple exposures on some tracks and skipping of others. With the step size S specified by equation (1), the effective track spacing Y is given by:

$$Y=d/k \tag{2}$$

Although not a necessary condition, it is advantageous to select N to be prime so as to ensure the greatest possible range of track spacings.

Several implementations of the '130 interleaving process are described in FIG. 2. FIG. 2-A involves an array of N=5 equally spaced diodes with an interleaving factor of k=2 and the spacing of the diodes in the array is shown as d. As indicated in FIG. 2-A, the effective track spacing (given by equation (1)) is Y=d/2 providing a resolution improvement proportional to the interleaving factor k over the actual diode spacing d. The step size of the diode array is given by equation (2) as S=5d/2. The array elements (diodes) are designated n=1,2, . . . 5 (designation not shown in FIG. 2). Elements n=1 and n=2 are not activated at the first array position p=1 which forms the first set of tracks and, consequently, are depicted as clear dots. Similarly, at the last position of the image, certain of the elements will not be activated (i.e. the elements not activated will be in reverse order of non-activated elements at the start of the image). Thus, elements n=4 and n=5 would not be activated on the last pass of the laser diode array. FIG. 2-B depicts the same diode array N=5 and diode spacing d, with an interleaving factor of k=4. As can be seen from the diagram, the spacing of the raster lines is further reduced to Y=d/4 and the step size required is S=5d/4. In FIG. 2-B, element n=1 is not turned on for array positions p=1,2, or 3. Similarly, element n=2 is not activated for p=1 or 2 and element n=3 is not turned on for p=1.

In general, raster line r spaced Y=d/k from an adjacent track is written by element n in an N element array at array position p according to:

$$r=Np-k(N-n) \tag{3}$$

Note that element n=N always writes raster line r=Np on pass p, regardless of interleaving factor k. This equation can easily be verified by examining FIGS. 2-A and 2-B.

Equation (3) can be used to generate a condition for which diodes will be inactive. An element n is inactivated at position p of an N element array if:

$$n-N-Np/k \tag{4}$$

Applied to FIG. 2-A, equation (4) indicates that for p=1, diodes n=5/2 will be inactivated. As shown in the diagram, n=1 and 2 are inactive for p=1. For p=2, equation (4) gives n=O and as shown in the diagram, none of the diodes are inactivated. Similarly for FIG. 2-B, for p=1,2 and 3, equation (4) yields n=3.75, 2.5, 1.25 respectively. Accordingly, as can be seen from the diagram, diodes n=1,2 and 3 are inactive for p=1, diodes n=1 and 2 are inactive for p=2 and diode n=1 is inactive for p=3.

To further reduce the effective track spacing on the recording surface a method can be adopted that combines the angled technique described by FIGS. 1-A and 1-B with the interleaving technique of FIGS. 2-A and 2-B. Such a technique requires incorporating the delay networks of the angled technique with the precise algorithms of the interleaving technique. This combination is of little practical difficulty because each technique may be independently implemented without affecting the other.

Another significant problem associated with diode arrays and their use in recording is the failure rate of the diodes. Moreover, if any of the diodes in an array fail, then the entire array is ruined and can no longer be used as a recording means. A need exists to overcome isolated failures of single diodes within the array, so that the array may still function.

Accordingly, it is an object of this invention to provide a fault tolerant diode array recording system which is capable of overcoming isolated diode failures within a diode array, so as to effectively record data onto a recording surface.

Another object of this invention is to provide a laser diode recording system that does not sacrifice resolution (i.e. effective track spacing) in order to achieve its goal of overcoming isolated diode failures within the diode array.

SUMMARY OF THE INVENTION

The present invention concerns a fault tolerant method of scanning for use in a device having an array of individually addressable elements comprising both primary elements and secondary elements. The individually addressable elements are operative to record data, thereby forming raster lines in parallel tracks on a recording surface. The method comprises several steps:

(a) selecting a set of active elements from within the array of individually addressable elements. The selected set of active elements is functional and all the non-activated elements are non-functional;

(b) moving the array so as to produce a set of raster lines in a set of parallel tracks on the recording surface. The set of raster lines is formed only by the elements in the set of active elements as the non-activated elements are non-functional;

(c) moving the array in predetermined discrete steps transverse to the parallel tracks;

(d) repeating the steps (b) and (c) so as to create an interleaving pattern. The interleaving pattern is structured to:

(i) allow raster lines to be created in parallel tracks on the recording surface, such that the parallel tracks are separated by a fraction of the separation of the array elements; and (ii) assign one of the primary elements and at least one of the secondary elements to each parallel track on the recording surface. Only one of the primary and secondary elements assigned to each track forms part of the set of active elements, the other being non-activated.

Preferably, the individually addressable elements of the invention may be laser diodes.

Advantageously, the selecting step (a) may further comprise detecting a failure in any primary elements.

The invention may further comprise orienting the array at an angle with respect to the parallel tracks on the recording surface and introducing delays into the flow of data to the set of active elements so as to effectively delay recording of particular elements. The addition of these steps providing for further reduction of the separation of the parallel tracks on the recording surface.

Advantageously, the invention may involve inactivating certain active elements during a preliminary number of the moving steps (b). These inactivated elements would not form raster lines during the preliminary moving steps (b). The inactivated elements may be inactivated according to the following equation:

$$n \leqq N(1-p/k)$$

where n is the index number of the elements inactivated;

N is the number of primary elements in the array;

p is the number of the moving step (b); and k is an integer called the interleaving factor.

A second aspect of the invention involves a fault tolerant method of scanning for use in a device having an array of individually addressable elements comprising both primary elements and secondary elements. The individually addressable elements are operative to record data and form raster lines in parallel tracks on a recording surface. The method comprises the steps of:

(a) testing the primary elements, thereby determining a set of functional primary elements and a set of failed primary elements;

(b) selecting and activating secondary elements, corresponding to the set of failed primary elements, such that the activated secondary elements may record data in particular tracks corresponding to those of the failed primary elements;

(c) moving the array relative to the recording surface so as to produce a first set of raster lines within a first set of parallel tracks on the recording surface. The first set of raster lines corresponding to the set of functional primary elements;

(d) moving the array a constant predetermined distance relative to the recording surface in a direction perpendicular to the parallel tracks. The predetermined distance is calculated so as to:

(i) align the primary elements over a new set of parallel tracks, such that at least one track of the new set of parallel tracks is interleaved with tracks from an immediately previous set of parallel tracks; and (ii) align the secondary elements, such that at least one of the secondary elements is positioned so as to overlap a track previously traced by a primary element, thereby forming a redundancy on any such overlapped tracks;

(e) moving the array relative to the recording surface, thereby:

(i) producing a new set of raster lines within the new set of parallel tracks, the new set of raster lines being formed by the set of functional primary elements; and (ii) taking advantage of the redundancy so as to produce a secondary set of raster lines, the secondary set of raster lines being formed by the activated secondary elements and only being formed on previous parallel tracks which are unrecorded because of failed primary elements;

(f) repeating steps (d) and (e) in such a manner that:

(i) each parallel track on the recording surface is assigned a redundancy of at least one primary element and one secondary element; and (ii) a raster line is recorded on each parallel track on the recording surface either by a functional primary element or an activated secondary element.

Another aspect of the invention involves a fault tolerant imaging apparatus, having an array of individually addressable elements operative to record data in multiple parallel tracks on a recording surface. The apparatus comprises a plurality of the individually addressable array elements, and within each plurality, there are several distinct groups of array elements. Each of the groups of array elements are assigned to a different one of the parallel tracks, and each group has a primary element operative to:

(i) receive input data;

(ii) activate in correspondence with the data; and (iii) record the data in the assigned track.

The apparatus further comprises a selection subsystem which, in the case of a failure of any of the primary elements, is operative to selectively activate a functional secondary element from within the group of array elements that contains the failure. The selectively activated functional secondary element is then operative to perform all functions of the failed primary element.

Advantageously, the selection subsystem may be further operative to detect a failure in any of the primary elements.

Preferably, the individually addressable array elements are laser diodes and the laser diodes may be single mode laser diodes or multi-mode laser diodes The array elements in the invention may be operative to record on the recording surface in a process which is either thermal or photonic in nature.

Preferably, the number of groups of elements within the plurality of array elements may be between 1 and 1000.

Another aspect of the present invention involves a fault tolerant imaging apparatus having an array of individually addressable elements which are operative to record data in multiple parallel tracks on a recording surface. The apparatus comprises a plurality of the individually addressable array elements, which are assigned to each of the parallel tracks. The plurality of array elements has a primary element, which is operative to:

(i) receive input data;

(ii) activate in correspondence with the data; and (iii) record the data in the assigned track.

The invention also comprises a selection subsystem which, in a case of a failure of the primary element, is operative to selectively activate a functional secondary element from within the plurality of array elements that contains the failure. The selectively activated secondary element is operative to perform all functions of the failed primary element.

DESCRIPTION OF THE PREFERRED EMBODIMENT

The invention herein disclosed concerns a method and apparatus for a fault tolerant recording system using an interleaving technique. The invention does not sacrifice the resolution (i.e. effective raster line spacing) to achieve its goal of fault tolerance.

Figure 3A:
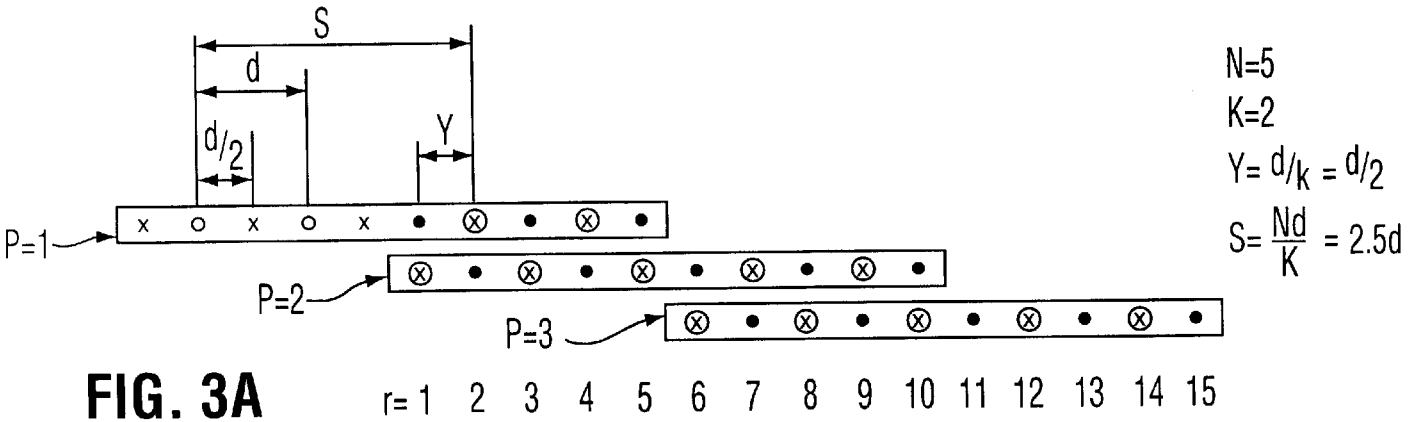
FIGS. 3A–3C schematically depict several implementations of the invention, showing how exactly one primary diode and one secondary diode are assigned to each track.
Figure 3B:
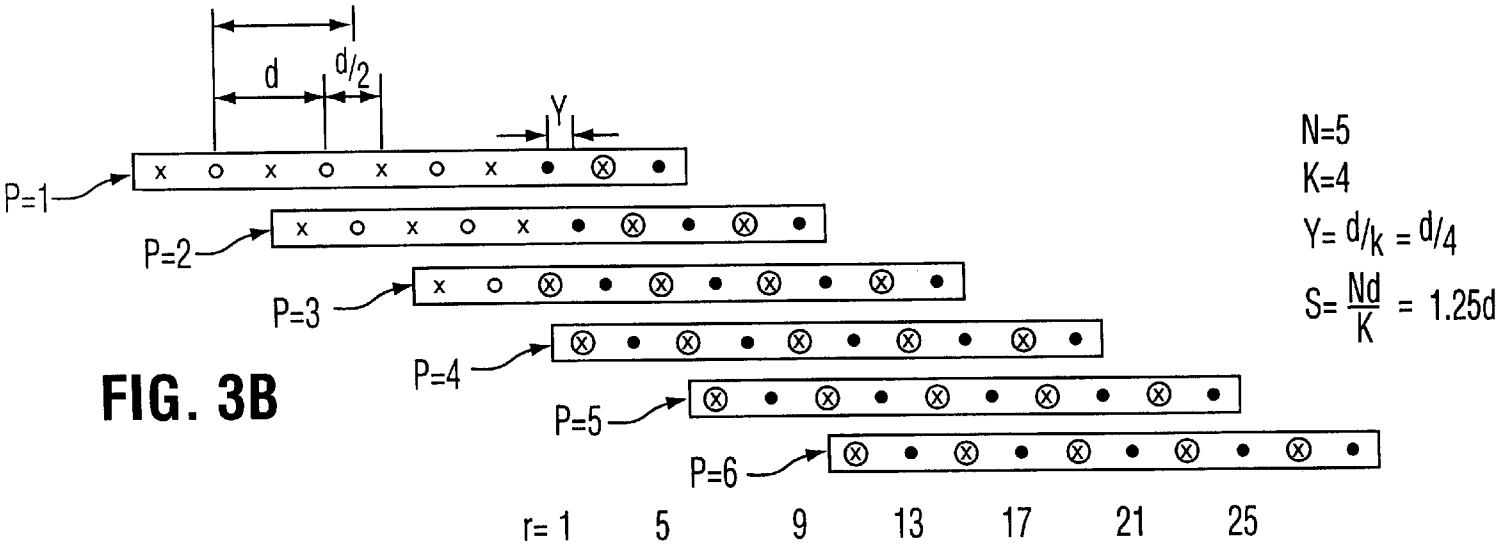
Figure 3C:
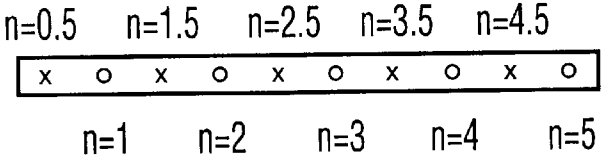

FIG. 3 depicts a schematic implementation of the present invention. A laser diode array comprises evenly spaced primary and secondary diodes. In FIG. 3, the primary diodes are represented by dots (open when inactive and colored in when active) and the secondary diodes are represented by crosses (bare crosses when "inactive" and circumscribed crosses when "potentially active"). As with the '130 patent, the primary diodes are separated by a distance d but according to the present invention, secondary diodes are interspaced at a distance d/2 from each primary diode. In order to keep the mathematics simple, some elementary changes to the definitions are required:

N-represents the number of primary array elements (i.e. not the total number of array elements)

n-represents the index of the primary array elements, but the secondary array elements represent half index numbers (i.e. the first secondary diode is indexed by n=0.5, the second secondary diode (halfway between n=1 and n=2) is indexed by n=1.5, the third secondary diode (halfway between n=2 and n=3) is indexed by n=2.5 and so on). This is depicted in FIG. 3-C.

FIG. 3-A depicts an implementation of the present invention for N=5 evenly spaced primary diodes and five corresponding secondary diodes. The interleaving factor for FIG. 3-A is k=2. As indicated in FIG. 3-A, the effective raster line spacing can still be calculated by equation (1) as Y=d/k=d/2 and the effective step size is still calculated according to equation (2) as S=Nd/k=5d/2. The diagram shows that exactly one primary diode and one secondary diode are assigned to each raster line. In this manner, a redundancy is created that can be used to overcome an isolated failure of a primary diode. If the primary diode assigned to a particular track fails, then the secondary diode is activated and the functionality of the system is maintained. The implementation of FIG. 3-A does not, however, provide the advantage of greater resolution offered by the '130 patent because the diode spacing between primary and secondary diodes is d/2 and for k=2, the effective track spacing is Y=d/2. Consequently, the invention does not provide a reduction in raster line spacing for k=2.

Figure 2A:
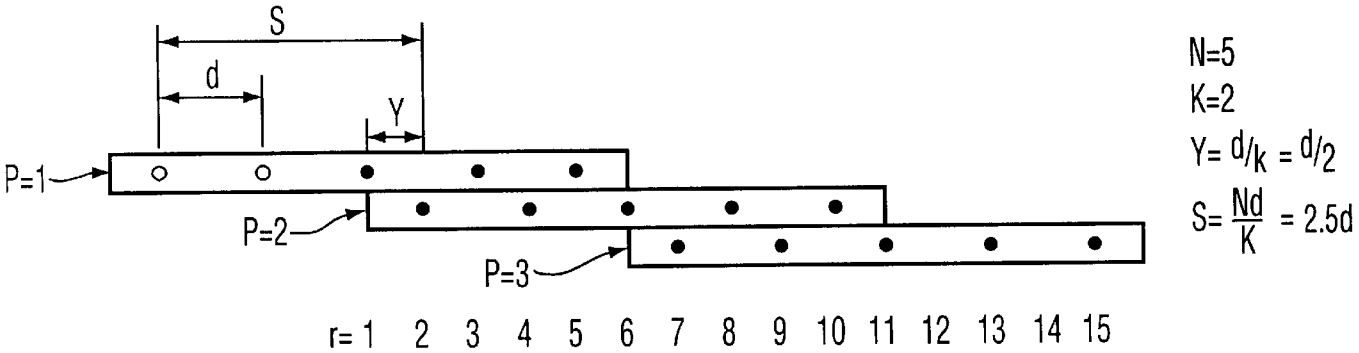
FIG. 2A PRIOR ART
FIGS. 2A and 2B schematically depicts the prior art in interleaving techniques for reducing the effective raster line spacing.
Figure 2B:
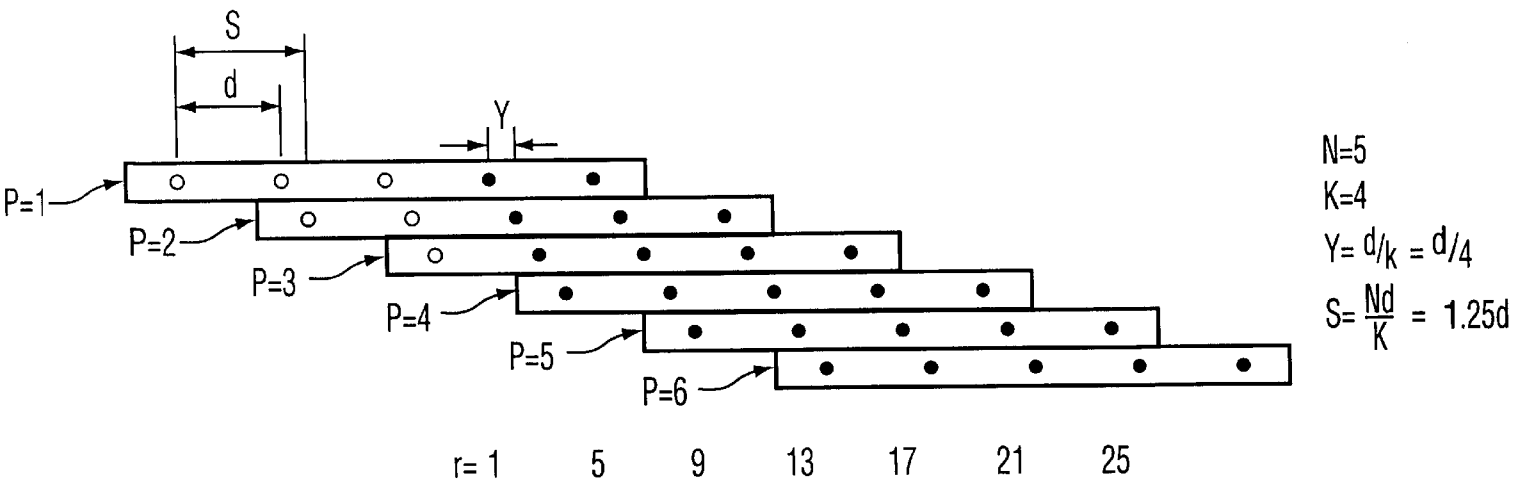
FIG. 2B PRIOR ART

An improvement in effective track spacing Y is available for k>2. Such an improvement is depicted in FIG. 3-B, which shows corresponds with FIG. 2-B and shows a system according to the present invention for N=5 and k=4 yielding an effective track spacing Y=d/4. FIG. 3-B shows how the present invention retains the reduction in effective track spacing Y that was offered by the interleaving process according to the '130 patent. Once again, one primary diode and one secondary diode are assigned to each track creating the required redundancy.

It should be noted that according to the present invention, the secondary diodes have three states of activation. Equation (4) describes when a particular diode will be inactive according to the interleaving process. That is, if a primary or secondary diode satisfies:

$$n=N-Np/k \tag{4}$$

then it will be "inactive". However, if a secondary diode does not satisfy equation (4), then it will only be "potentially active" because a secondary diode will not be "truly active" unless the primary diode fails. Thus, for the purposes of this application, a secondary diode may be in one of three states:

(i) "inactive": if the secondary diode satisfies equation (4);

(ii) "potentially active": if the secondary diode does not satisfy equation (4) and the primary diode corresponding to the same track is functional; or (iii) "truly active": if the secondary diode does not satisfy equation (4) and the primary diode corresponding to the same track has failed.

Figure 4A:
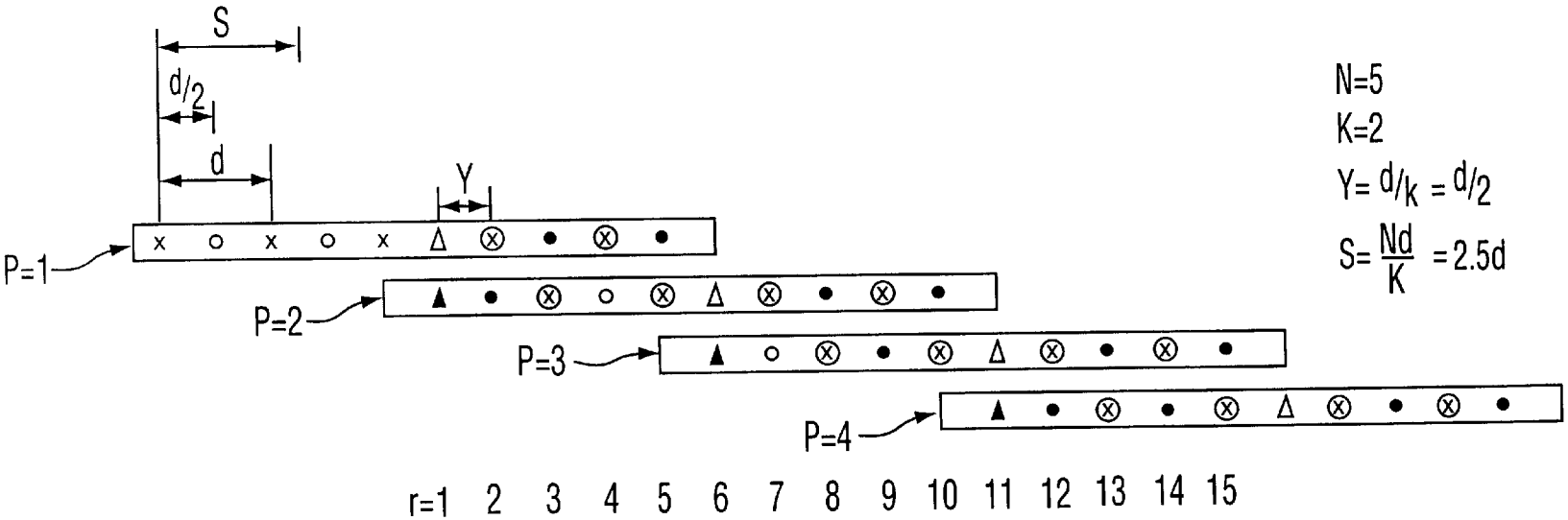
FIGS. 4A and 4B schematically depicts several implementations of the invention, showing how the redundancy of having exactly one primary diode and one secondary diode assigned to eac h track can be exploited to overcome the failure of an isolated diode.
Figure 4B:
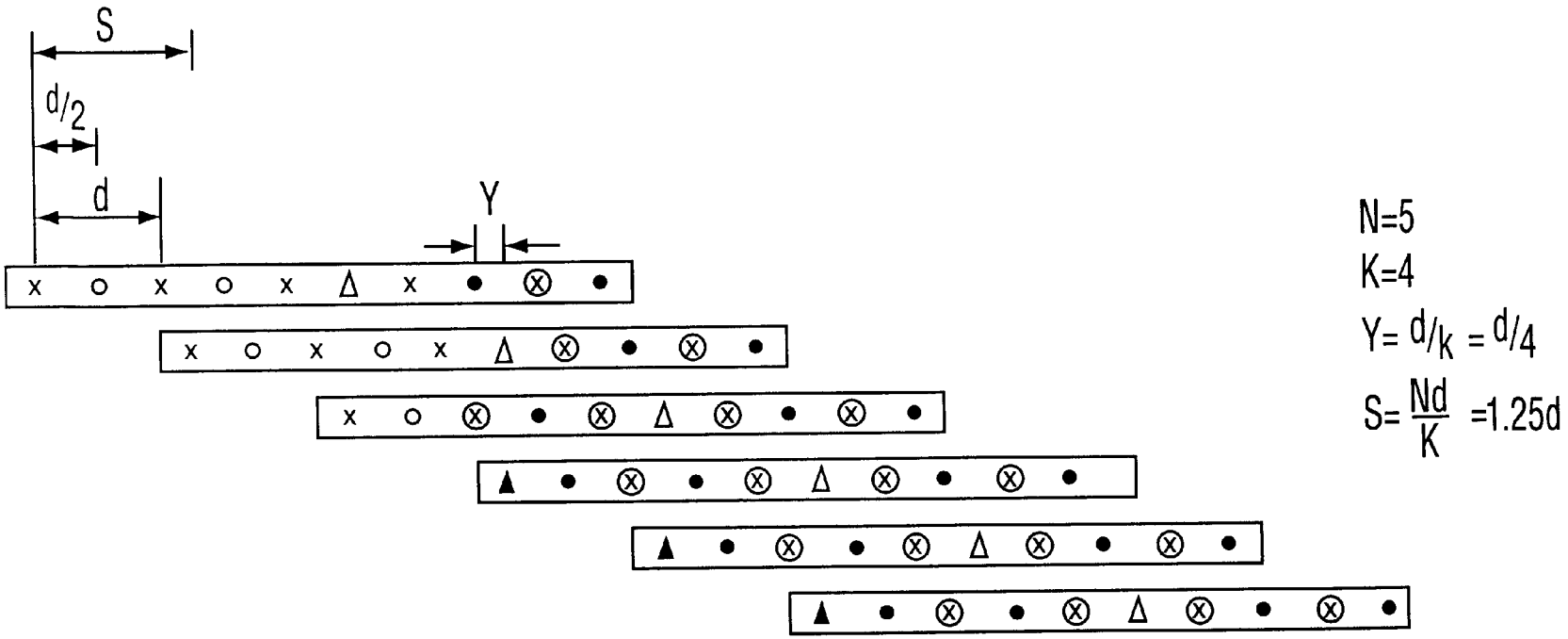

FIG. 4 depicts the present invention when there is a failure in the primary diode n=3. As with FIG. 3, inactive primary diodes are represented by open dots, active primary diodes are represented by closed dots, inactive secondary diodes are represented by crosses and potentially active secondary diodes are represented by circumscribed crosses. In FIG. 4, however, failed primary diodes are represented by open triangles and truly active secondary diodes are represented by closed triangles. FIG. 4-A depicts the case for k=2 and FIG. 4-B depicts the case for k=4. As can be seen from the diagram, in both instances, where there is a failure of primary diode n=3, secondary diode n=0.5 can be activated in lieu of the failed primary diode. The redundancy available from having two separate diodes assigned to each track is exploited to provide a fault tolerance mechanism which is capable of overcoming the isolated failure of individual diodes.

In general, the relationship for a given primary diode $n_{primary}$ and the secondary diode $n_{secondary}$, which is assigned to the same track is given by:

$$ABS(n_{primary}-n_{secondary})=N/2 \tag{5}$$

Thus, for N=5, primary diodes n=1, 2, 3, 4 and 5 correspond with secondary diodes n=3.5, 4.5, 0.5, 1.5 and 2.5 respectively. This relationship can be easily verified by examining FIGS. 3 and 4.

The preferred embodiment of the present invention, as described above, places several requirements on N and k to ensure that the interleaving process places exactly one primary and one secondary diode on each raster line. The interleaving factor k must be even and the number of elements in the diode array N must be chosen such that the lowest common multiple of N and k is Nk. This necessarily implies that N is odd.

The invention herein disclosed is not limited, however, by the preferred embodiment and is meant to include any method and apparatus where an exact number of diodes are assigned to each track of a recording surface in order to provide redundancy and to overcome isolated diode failures.

Figure 5:
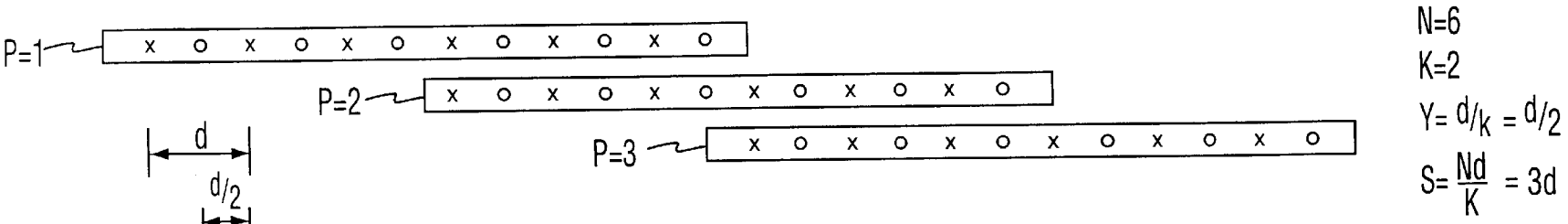
FIG. 5 depicts an alternate embodiment of the present invention.

A second embodiment of the invention may occur where N and k have common factors. If N and k have common factors, then there will not be exactly one primary and one secondary diode assigned to each track on the recording surface. In some cases, such as the one depicted in FIG. 5, where N=6 and k=2, there will be an assignment of exactly two diodes to each track. However, in this case, each track is assigned two secondary diodes, or two primary diodes, making it slightly different when implementing the selection mechanism for which diodes are active and which are not.

Figure 6:
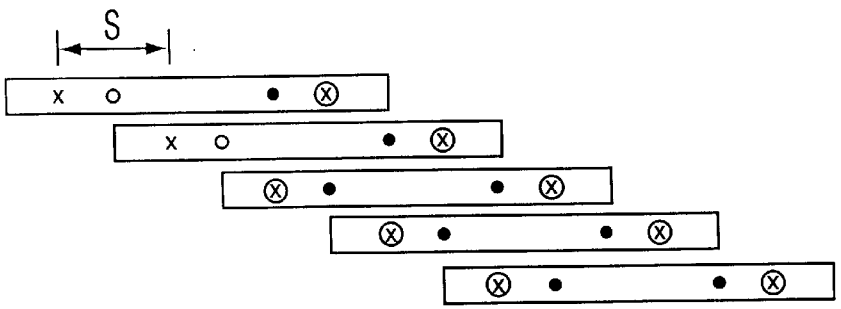
FIG. 6 depicts a second alternate embodiment of the present invention.

A third embodiment of the invention is depicted in FIG. 6 in this embodiment, an "abnormal" geometry of diodes is used to achieve redundancy. As can be seen from the diagram, this particular geometry can be used to effect the desired redundancy and to assign exactly one primary diode and one secondary diode to each track.

The invention herein disclosed is also not limited by the level of redundancy. That is an N and k may be easily selected so as to provide for three or more levels of redundancy wherein there are more than one secondary diode, in the event that there is more than one failed diode.

Using any of the aforementioned interleaving techniques, the redundancy available from having multiple separate diodes assigned to a single track is exploited to provide a fault tolerance and to overcome the isolated failure of individual diodes.

A testing scheme is required to determine which, if any, diodes have failed. This testing may be implemented by analysis of either the output or input characteristics of the diodes. In attempting a prescribed test print run, where each diode is selectively activated, the functional output of the diodes may be tested on a recording surface or a light detector. Alternatively or in addition, the test may involve electronically testing the characteristics of each diode. Once the testing has determined that one or more failures exist, the primary and secondary diodes can be configured so as to activate the functional diodes and to maintain the overall system functionality.

Figure 7:
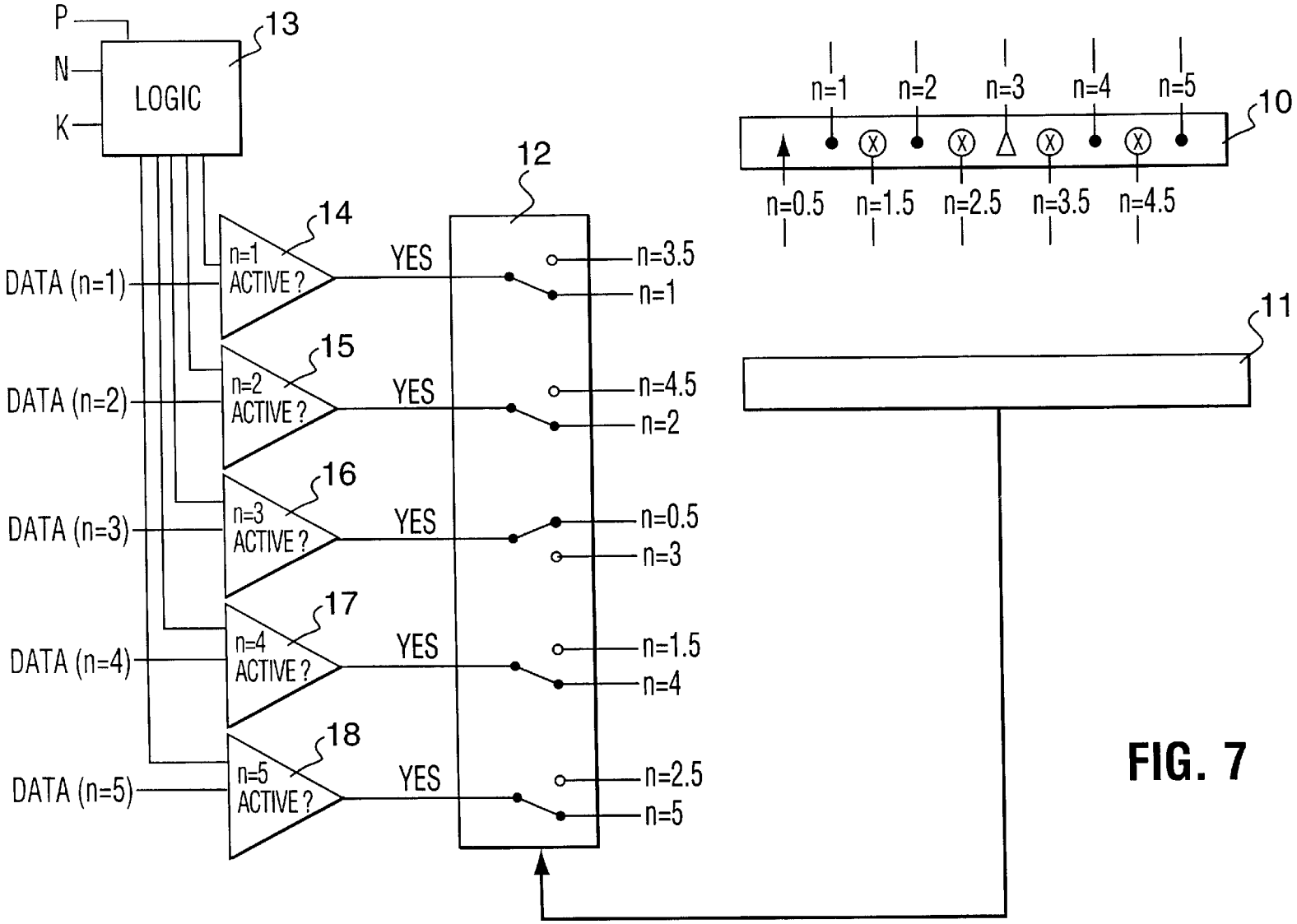
FIG. 7 shows the architecture of the preferred embodiment of the present invention and how the invention is used to overcome the failure of an isolated diode.

FIG. 7 depicts the system architecture for the fault tolerant interleaving process and also shows how the system is used to overcome a diode failure. FIG. 7 corresponds with FIGS. 4-A and 4-B in that N=5, k=2 or 4 and there is a failure in diode n=3.

In a test printing run, the individual diodes (n=0.5, 1, 1.5, 2, 2.5 . . . 5) of the array 10 are tested on light detector 11. During the test, it is determined that primary diode n=3 is not working and consequently, secondary diode n=0.5 will be employed. The information relating to the functionality of the various diodes (n=0.5, 1, 1.5, 2, 2.5 . . . 5) of the array 10 is fed back to multiplexer 12 which selects the appropriate diodes for the various data lines. Logic from a process control unit 13 uses the interleaving variables N and k to determine whether a particular primary diode (n=1, 2, 3, 4, 5) should be active for a given array position p. If a particular primary diode (n=1, 2, 3, 4, or 5) is determined to be active at that array position p, then the appropriate incoming data (DATA(n=1), DATA(n=2), . . . DATA(n=5)) is fed through to multiplexer 12. For data lines (DATA(n=1), DATA(n=2), DATA(n=4) and DATA(n=5)), the primary diodes (n=1, 2, 4 and 5) are functional and so the multiplexer 12 switches are configured so that data flows on a straight connection through to the appropriate primary diodes (n=1, 2, 4 and 5). In the case of DATA(n=3), the multiplexer is switched so that the data flows to secondary diode n=0.5.

Figure 1A:
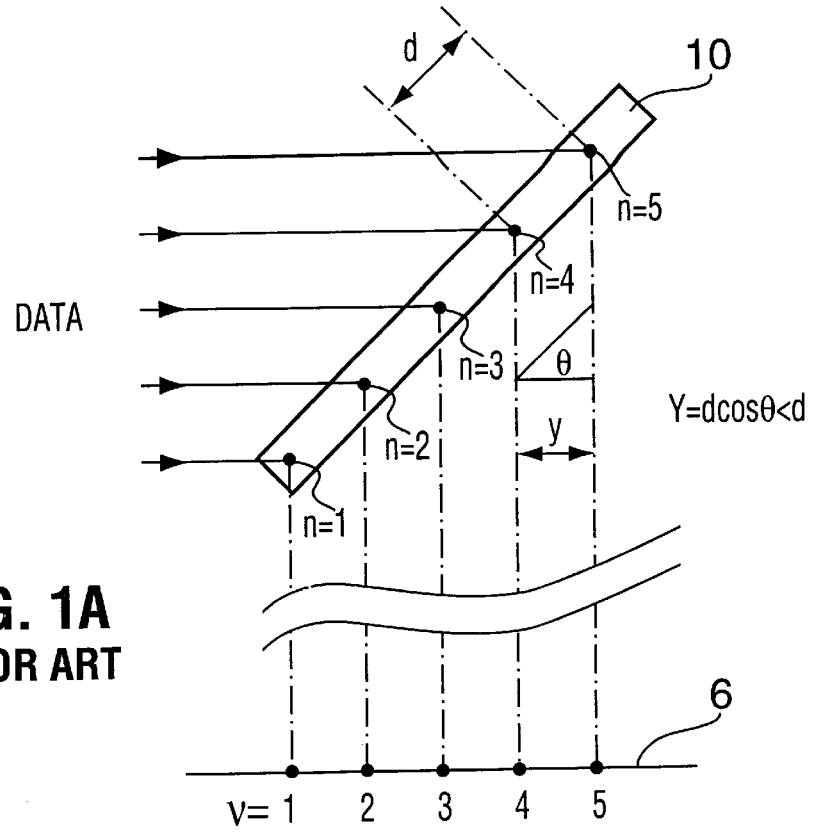
FIG. 1A PRIOR ART
FIGS. 1A and 1B depict the prior art in angled diode array recording systems. The drawing depicts the manner in which the angled diode array coupled with digital delay techniques is used to reduce the effective track spacing.
Figure 1B:
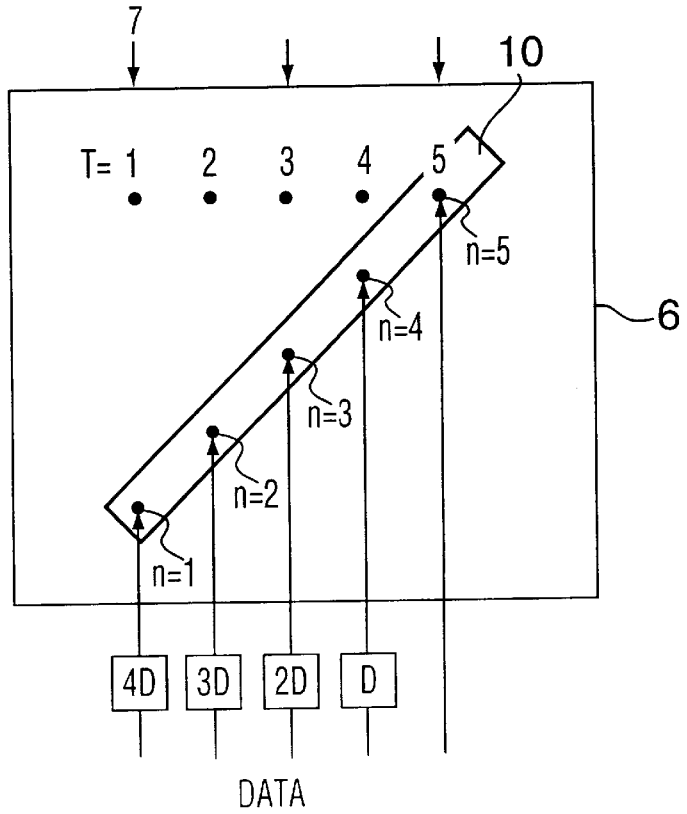
FIG. 1B PRIOR ART

To reduce the effective raster line spacing even further, the invention can employ a combination of the angled technique described by FIGS. 1-A and 1-B with the interleaving technique of FIGS. 3 and 4. Such a combination requires incorporating: the delay networks of the angled approach, the precise algorithms and logic of the of the interleaving technique and the selection mechanisms of the redundancy procedure. Such a combination is of little practical difficulty because each technique may be independently implemented without affecting the other. Implementation of this multifaceted approach merely involves a linear combination of the delay networks of FIG. 1-B with the selection networks of FIG. 7.

What is claimed is:

1. A fault tolerant method of scanning for use in a device having an array of individually addressable elements comprising both primary elements and secondary elements, said individually addressable elements operative to record data forming raster lines in parallel tracks on a recording surface, and said method comprising the steps of:

(a) selecting a set of active elements from within said array of individually addressable elements, said active elements being completely functional and all other elements being non-activated;

(b) moving said array so as to produce a set of raster lines in a set of parallel tracks on said recording surface, said set of raster lines being formed only by said set of active elements;

(c) moving said array in predetermined discrete steps transverse to said parallel tracks;

(d) repeating steps (b) and (c) so as to create an interleaving pattern, said interleaving pattern:

(i) allowing raster lines to be created in parallel tracks on said recording surface which parallel tracks are separated by a fraction of the separation of said array elements; and (ii) having one of said primary elements and at least one of said secondary elements assigned to each parallel track on said recording surface, with only one of said primary and secondary elements forming part of said set of active elements.

2. A method according to claim 1, wherein said individually addressable elements are laser diodes.

3. A method according to claim 1, wherein said selecting step (a) further comprises detecting a failure in any primary elements.

4. A method according to claim 1, which further comprises:

(a) orienting said array at an angle with respect to said parallel tracks on said recording surface; and (b) introducing delays into the flow of data to said set of active elements so as to effectively delay recording of particular elements;

said orienting and introducing steps providing for further reduction of the separation of the parallel tracks on said recording surface.

5. A method according to claim 1, wherein certain active elements are inactivated during a preliminary number of said moving steps (b), said inactivated elements not forming raster lines.

6. A method according to claim 5, wherein said inactivated elements are inactivated according to:

$$n \leq N(1-p/k)$$

where n is an index number of the elements inactivated;

N is a number of primary elements in the array;

p is a number of said moving step (b); and k is an integer.

7. A fault tolerant method of scanning for use in a device having an array of individually addressable elements comprising both primary elements and secondary elements, said individually addressable elements operative to record data forming raster lines in parallel tracks on a recording surface, and said method comprising the steps of:

(a) testing said primary elements, thereby determining a set of functional primary elements and a set of failed primary elements;

(b) selecting and activating secondary elements, corresponding to said set of failed primary elements, such that said activated secondary elements may record data in particular tracks corresponding to those of said failed primary elements;

(c) moving said array relative to said recording surface so as to produce a first set of raster lines within a first set of parallel tracks on said recording surface, said first set of raster lines corresponding to said set of functional primary elements;

(d) moving said array a constant predetermined distance relative to said recording surface in a direction perpendicular to said parallel tracks, said predetermined distance calculated so as to:

(i) align said primary elements over a new set of parallel tracks, at least one track of said new set of parallel tracks being interleaved with tracks from an immediately previous set of parallel tracks; and (ii) align said secondary elements, such that at least one of said secondary elements is positioned so as to overlap a track previously traced by a primary element, forming a redundancy on any such overlapped tracks;

(e) moving said array relative to said recording surface, thereby:

(i) producing a new set of raster lines within said new set of parallel tracks, said new set of raster lines being formed by the set of functional primary elements; and (ii) taking advantage of said redundancy so as to produce a secondary set of raster lines, said secondary set of raster lines being formed by said activated secondary elements and only being formed on previous parallel tracks which are unrecorded because of failed primary elements;

(f) repeating steps (d) and (e) in such a manner that:

(i) each parallel track on the recording surface is assigned a redundancy of at least one primary element and one secondary element; and (ii) a raster line is recorded on each parallel track on the recording surface by one of: a functional primary element and an activated secondary element.

8. A method according to claim 7, wherein said individually addressable elements are laser diodes.

9. A method according to claim 7, which further comprises:

(a) orienting said array at an angle with respect to said parallel tracks on said recording surface; and (b) introducing delays into the flow of data to said set of functional primary elements and said activated secondary elements so as to effectively delay recording of particular elements;

said orienting and introducing steps providing for further reduction of the separation of the parallel tracks on said recording surface.

10. A method according to claim 7, wherein certain functional primary elements and certain activated secondary elements are inactivated during a preliminary number of said moving steps (c) and (e), said inactivated elements not forming raster lines.

11. A method according to claim 10, wherein said inactivated elements are inactivated according to:

$$n \leqq N(1-p/k)$$

where n is an index number of the elements inactivated;

N is a number of primary elements in the array;

p is number of said moving step (b); and k is an integer.

12. A fault tolerant imaging apparatus, having an array of individually addressable elements operative to record data in multiple parallel tracks on a recording surface, said apparatus comprising:

(a) a plurality of said individually addressable array elements, said plurality comprising several groups of array elements, each of said groups of array elements assigned to a different one of said parallel tracks, and each of said groups of array elements having a primary element, said primary element operative to:

(i) receive input data;

(ii) activate in correspondence with said data; and (iii) record said data in said assigned track; and (b) a selection subsystem which, in the case of a failure of any of said primary elements, is operative to selectively activate a functional secondary element within said group of array elements that contains said failure, said selectively activated functional secondary element operative to perform all functions of said failed primary element.

13. An apparatus according to claim 12, wherein said selection subsystem is further operative to detect a failure in any of said primary elements.

14. An apparatus according to claim 12, wherein said individually addressable array elements are laser diodes.

15. An apparatus according to claim 14, wherein said laser diodes comprise diodes which are one of: single mode laser diodes and multi-mode laser diodes.

16. An apparatus according to claim 12, wherein said array elements are operative to record on said recording surface in a recording process which is one of: thermal in nature and photonic in nature.

17. An apparatus according to claim 12, wherein the number of groups of elements within said plurality of array elements is between 1 and 1000.

18. A fault tolerant imaging apparatus having an array of individually addressable elements operative to record data in multiple parallel tracks on a recording surface, said apparatus comprising:

(a) a plurality of said individually addressable array elements assigned to each of said parallel tracks, said plurality of array elements having a primary element, said primary element operative to:

(i) receive input data;

(ii) activate in correspondence with said data; and (iii) record said data in said assigned track; and (b) a selection subsystem which, in a case of a failure of said primary element, is operative to selectively activate a functional secondary element within said plurality of array elements that contains said failure, said selectively activated secondary element operative to perform all functions of said failed primary element.

19. An apparatus according to claim 18, wherein said selection subsystem is further operative to detect a failure of said primary element.

20. An apparatus according to claim 18, wherein said array elements are laser diodes.

21. An apparatus according to claim 18, wherein said laser diodes comprise diodes which are one of: single mode laser diodes and multi-mode laser diodes.

22. An apparatus according to claim 18, wherein said array elements are operative to record on said recording surface in a recording process which is one of: thermal in nature and photonic in nature.

23. An apparatus according to claim 18, wherein said multiple parallel tracks number between 1 and 1000.

* * * * *